US011980240B2

(12) United States Patent
Gosse et al.

(10) Patent No.: US 11,980,240 B2
(45) Date of Patent: May 14, 2024

(54) VENTILATED JACKET WITH A WING

(71) Applicant: Harley-Davidson Motor Company, Inc., Milwaukee, WI (US)

(72) Inventors: Andrew William Gosse, Grafton, WI (US); Robert James Brummond, Sussex, WI (US); Jason John Berndt, Shorewood, WI (US)

(73) Assignee: Harley-Davidson Motor Company, Inc., Milwaukee, WI (US)

( * ) Notice: Subject to any disclaimer, the term of this patent is extended or adjusted under 35 U.S.C. 154(b) by 8 days.

(21) Appl. No.: 17/692,733

(22) Filed: Mar. 11, 2022

(65) Prior Publication Data

US 2023/0284720 A1 Sep. 14, 2023

(51) Int. Cl.

| | |
|---|---|
| ***A41D 27/28*** | (2006.01) |
| ***A41D 1/02*** | (2006.01) |
| ***A41D 3/00*** | (2006.01) |

(52) U.S. Cl.

CPC ..... *A41D 27/285* (2013.01); *A41D 1/02* (2013.01); *A41D 3/00* (2013.01); *A41D 2400/24* (2013.01); *A41D 2600/102* (2013.01)

(58) Field of Classification Search

CPC .... A41D 27/285; A41D 1/02; A41D 2400/24; A41D 2600/102; A41D 2600/104; A41D 3/00; A41D 3/02; A41D 13/0158; A41D 2300/20; A41D 2300/22; A41D 2300/24; A41D 27/28; A41D 1/084; A41D 13/0025; A41D 13/0015; A41D 31/18; B64C 33/00; B64D 10/00; B64D 10/17

See application file for complete search history.

(56) References Cited

U.S. PATENT DOCUMENTS 422,669 A * 3/1890 Upthegrove ..... A41D 1/02 2/93
1,278,310 A * 9/1918 D'Annunzio ..... A41D 1/02 2/93

(Continued)

FOREIGN PATENT DOCUMENTS

CH 382694 A 10/1964

OTHER PUBLICATIONS

Extended European Search Report for Application No. 23156646.4 dated Jul. 7, 2023 (5 pages).

*Primary Examiner* — Heather Mangine
*Assistant Examiner* — Raquel M. Weis
(74) *Attorney, Agent, or Firm* — Michael Best & Friedrich LLP

(57) ABSTRACT

A ventilated jacket includes a body portion having a front side and a rear side, a sleeve portion extending from the body portion, and a ventilation system including a plurality of vent openings configured to allow airflow into and out of the jacket. The ventilation system includes an underarm vent having a first end and a second end, the underarm vent extends across a seam between the body portion and the sleeve portion. The jacket further includes a wing that follows a path established by a rear side of the underarm vent. The wing includes a first end adjacent the first end of the underarm vent and a second end adjacent the second end of the underarm vent. The wing extending outward from the underarm vent to channel oncoming air into the underarm vent when the sleeve portion is held in an extended orientation away from the body portion.

21 Claims, 7 Drawing Sheets

(56) References Cited

U.S. PATENT DOCUMENTS 1,360,390 A * 11/1920 Gilfillan ..... A41D 27/28 2/DIG. 1
1,388,563 A * 8/1921 Hanson ..... A41D 1/02 2/93
1,973,419 A * 9/1934 Trageser ..... A41D 27/10 2/93
2,314,226 A * 3/1943 Lee ..... A41D 27/10 D2/837
2,457,356 A * 12/1948 Enck ..... A41D 1/02 D2/834
2,716,240 A * 8/1955 Trageser ..... A41D 27/10 2/93
3,086,215 A * 4/1963 Di Paola ..... A41D 27/28 2/87
3,153,793 A * 10/1964 Lepore ..... A41D 3/00 2/93
3,206,762 A * 9/1965 Smith ..... A41D 27/10 2/93
3,213,465 A * 10/1965 Ludwikowski ..... A41D 27/28 2/268
4,195,362 A * 4/1980 Rolando ..... A41D 3/00 2/2.5
4,220,299 A * 9/1980 Motter ..... B64D 17/00 2/84
4,608,715 A * 9/1986 Miller ..... A41D 27/285 2/87
4,722,099 A * 2/1988 Kratz ..... A41D 27/28 2/93
4,884,768 A * 12/1989 Ansley ..... B64D 10/00 280/810
5,105,477 A * 4/1992 Golde ..... A41D 27/10 2/93
5,176,600 A * 1/1993 Wilkinson ..... A63B 21/4021 482/122
5,406,647 A * 4/1995 Lew ..... A41D 13/00 2/88
5,642,526 A * 7/1997 Thompson ..... A41D 13/02 2/DIG. 1
5,781,930 A * 7/1998 Boshoff ..... A41D 13/00 2/93
6,263,510 B1 * 7/2001 Bay ..... A41D 27/28 2/93
6,848,119 B2 * 2/2005 Crye ..... A42B 3/10 2/243.1
7,017,191 B2 * 3/2006 Golde ..... A41D 27/28 2/60
7,111,328 B2 * 9/2006 Bay ..... A41D 13/0581 2/93
7,117,538 B2 * 10/2006 Bosne ..... A41D 13/0015 2/93
7,284,282 B2 * 10/2007 Bay ..... A41D 27/28 2/93
7,954,173 B2 * 6/2011 Collier ..... A41D 1/06 2/93
7,966,668 B2 * 6/2011 Bay ..... A41D 27/28 2/93
8,001,618 B2 * 8/2011 Bay ..... A41D 27/28 2/96
8,276,213 B2 * 10/2012 Maurer ..... A41D 27/24 2/248
8,336,116 B2 * 12/2012 Seguin ..... A41D 27/28 2/96
8,713,712 B2 * 5/2014 Maurer ..... A41D 27/24 5/413 R
9,301,556 B2 * 4/2016 Koller ..... A41D 3/02
11,160,318 B2 * 11/2021 Neves ..... A41D 31/00
2003/0138586 A1 * 7/2003 Fowler ..... B29C 65/5085 428/102
2004/0221362 A1 * 11/2004 Bosne ..... A41D 13/0015 2/93
2008/0040832 A1 * 2/2008 Bay ..... A41D 27/28 2/93
2008/0263743 A1 * 10/2008 Maurer ..... A41D 27/24 2/69
2009/0077710 A1 * 3/2009 Bay ..... A41D 3/00 2/243.1
2012/0023648 A1 * 2/2012 Dainese ..... A41D 13/0155 2/463
2013/0333092 A1 * 12/2013 Hodgson ..... A41D 3/04 2/243.1
2014/0196192 A1 * 7/2014 Koller ..... A41D 3/00 2/85
2016/0135529 A1 * 5/2016 Traulle ..... A41D 3/02 2/243.1
2016/0198778 A1 * 7/2016 Hines ..... C08K 5/0091 2/269
2017/0035122 A1 * 2/2017 Farron ..... A41D 1/04
2019/0110528 A1 * 4/2019 West ..... A41D 3/02
2019/0150539 A1 * 5/2019 Hiney ..... A41D 27/285
2021/0137192 A1 * 5/2021 Rafn ..... A41D 31/145

* cited by examiner

VENTILATED JACKET WITH A WING

FIELD OF THE INVENTION

The present invention relates to a jacket having a ventilation system, for example a motorcycle jacket.

BACKGROUND OF THE INVENTION

A motorcycle rider encounters traveling wind when riding a motorcycle, especially on a motorcycle with only partial or no front fairing. A jacket can be worn by the motorcyclist for protection, and the jacket may be vented for air flow in warmer weather conditions.

SUMMARY OF THE INVENTION

In one aspect, the invention provides a ventilated jacket. The ventilated jacket includes a body portion having a front side and a rear side, wherein the front side of the body portion contains a central fastening member that extends continuously from a top to a bottom of the front side, a sleeve portion extending from the body portion and connecting to the body portion via an armscye seam, and a ventilation system including a plurality of vent openings configured to allow airflow into and out of the ventilated jacket. The ventilation system includes an underarm vent having a first end and a second end, the underarm vent extends across the armscye seam in an axillary region between the body portion and the sleeve portion. The ventilated jacket further includes a wing that follows a path established by the rear side of the underarm vent. The wing includes a first end adjacent the first end of the underarm vent and a second end adjacent the second end of the underarm vent. The wing extends outward from the underarm vent to channel oncoming air into the underarm vent when the sleeve portion is held in an extended orientation away from the body portion.

In another aspect, the invention provides a ventilated jacket. The ventilated jacket includes a body portion having a front side and a rear side, wherein the front side of the body portion contains a central fastening member that extends continuously from a top to a bottom of the front side; a sleeve portion extending from the body portion and connecting to the body portion via an armscye seam; an underarm vent that extends across the armscye seam in an axillary region between the body portion and the sleeve portion including a first fastening member configured to move the underarm vent between an open position and a closed position, a front vent extending along the front side of the body portion including a second fastening member configured to move the front vent between an open position and a closed position, a rear vent extending along the rear side of the body portion including a third fastening member configured to move the rear vent between an open position and a closed position, and a wing positioned on the rear side of the body portion at a rear side of first fastening member of the underarm vent. The wing includes a first end and a second end and has a boomerang shape that directs air into the underarm vent.

In yet another aspect, the invention provides a ventilated jacket. The ventilated jacket includes a body portion having a front side and a rear side, wherein the front side of the body portion contains a central fastening member that extends continuously from a top to a bottom of the front side; a sleeve portion extending from the body portion and connecting to the body portion via an armscye seam, and a ventilation system including a plurality of vent openings configured to allow airflow into and out of the ventilated jacket. The ventilation system includes an underarm vent having a first end and a second end. The underarm vent extends across the armscye seam in an axillary region between the body portion and the sleeve portion. The ventilated jacket further includes a wing that follows a vent path established by the rear side of the underarm vent. The wing includes a first end adjacent the first end of the underarm vent, a second end adjacent the second end of the underarm vent, a proximal edge secured to the body and sleeve portions along the vent path, and a distal edge spaced from the vent path. The wing further includes a central seam formed by sewing together pieces of non-stretch material having opposing curvatures.

DETAILED DESCRIPTION

Figure 1:
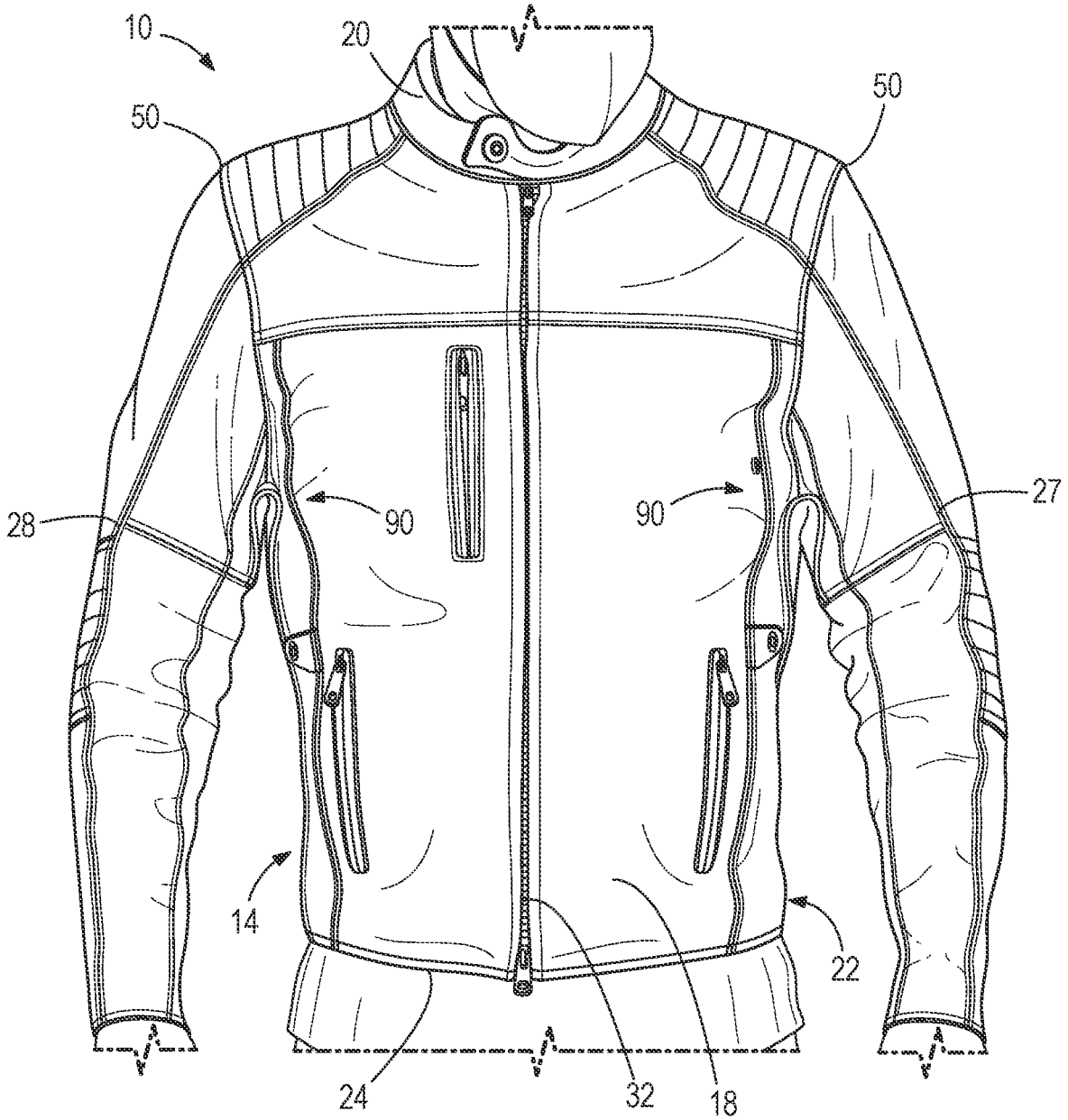
FIG. 1 is a perspective view of a ventilated jacket, showing a front side of a body portion.
Figure 2:
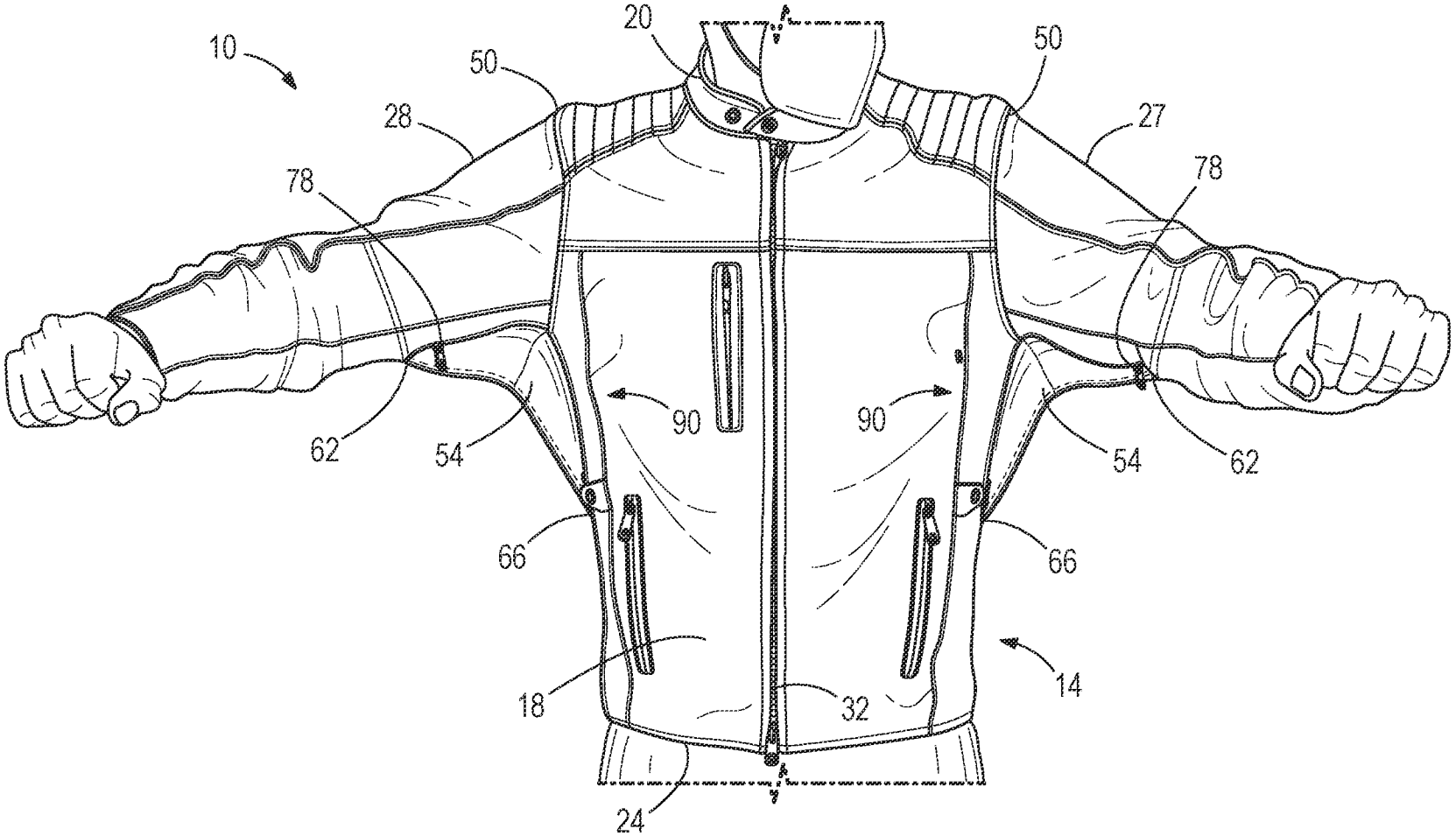
FIG. 2 is a perspective view of the ventilated jacket of FIG. 1, with a pair of sleeve portions in an extended orientation exposing a wing.

Before any embodiments of the invention are explained detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-8 illustrate a ventilated jacket 10, in particular a motorcycle jacket. The ventilated jacket 10 can be used while operating a motorcycle and during activities other than motorcycling. The jacket 10 includes a body portion 14 having a front side 18 and a rear side 22 opposite the front side 18. Extending between the front side 18 and the rear side 22 of the body portion 14 is a pair of sleeve portions (i.e., a left sleeve 27 defining a left side of the jacket 10 and a right sleeve 28 defining a right side of the jacket 10). A bottom edge 24 of the jacket 10 is defined at a lower portion of the body portion 14 and forms a waist opening. A neck opening 20 is positioned at a top portion of the body portion 14. Both, the bottom edge 24 and the neck opening 20, are positioned between the left sleeve 27 and the right sleeve 28. A central fastening member 32, configured to convert the jacket 10 between an open position and a closed position, extends along the front side 18 of the body portion 14. The central fastening member 32 is a zipper, although other types of fastening members can be used. The jacket 10 is made of leather, synthetic leather, nylon, polyester, other textile materials, or combinations thereof. Optionally, the jacket 10 can incorporate padding or armor.

The ventilated jacket 10 further includes a ventilation system including, on each side of the jacket 10, an underarm vent 38, a front vent 90, and a rear vent 94. Each vent is an air permeable opening defined within the jacket 10 to ventilate the jacket 10. Air flow can pass through the openings and penetrate an air permeable material optionally provided across each of the vents. The ventilation system is configured to allow air flow in and out of the jacket 10, such that each vent can act as either an inlet vent or an outlet vent for air flow. In some constructions, the jacket 10 can incorporate, in addition to features disclosed herein, some or all of the features disclosed in U.S. Pat. No. 9,301,556, the entire contents of which are incorporated by reference herein.

Figure 3:
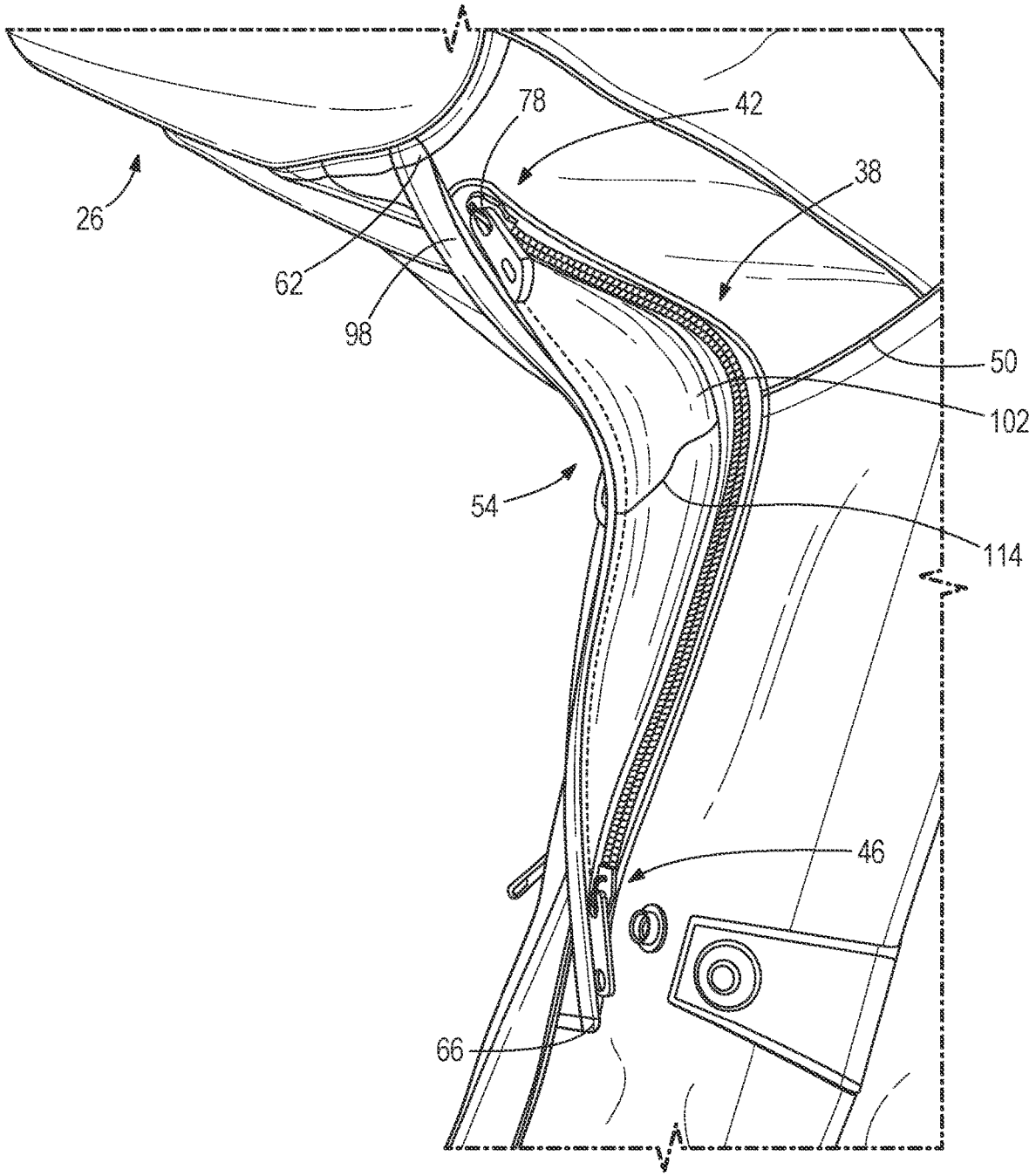
FIG. 3 is an enlarged perspective view of the wing of FIG. 2.
Figure 4:
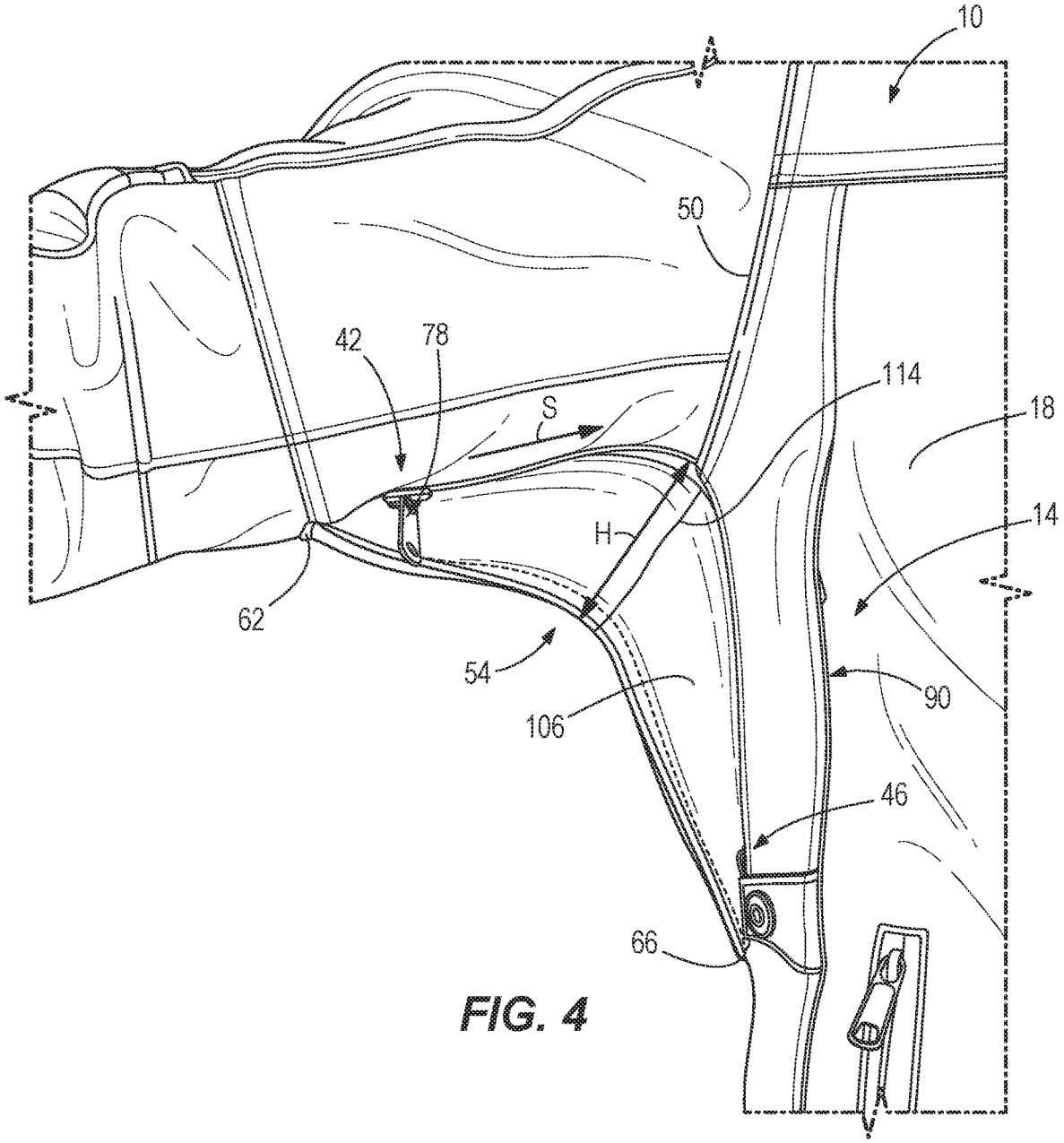
FIG. 4 is a front view of the wing of FIG. 2.

Referring to FIGS. 3-4, the underarm vent 38 includes a first end 42 and a second end 46 opposite the first end 42. The underarm vent 38 extends across a armscye seam 50 and between the body portion 14 and a respective one of the sleeves 27, 28. The armscye seam 50 connects and forms a joint between the body portion 14 and one of the sleeves 27, 28. With a first fastening member 78, the underarm vent 38 is configured to move between an open position and a closed position. Air flow is allowed to pass through the underarm vent 38 when the first fastening member 78 is in the open position. In the closed position, the first fastening member 78 prevents air flow from passing through the underarm vent 38. The first fastening member 78 has a length that is between 200 mm and 500 mm (e.g., 340 to 360 mm) in some constructions.

The front vent 90 extends along the front side 18 of the body portion 14 and includes a second fastening member (not shown). The rear vent 94 includes a third fastening member 86 and extends along the rear side 22 of the body portion 14. The front vent 90 and the rear vent 94 are shown as extending in a vertical orientation along the body portion 14. However, the front vent 90 and the rear vent 94 can extend at an angle depending on the orientation in which the jacket 10 is being worn. Similar to the first fastening member 78, the second fastening member 82 and the third fastening member 86 are configured to move the front vent 90 and the rear vent 94, respectively, between an open position that allows air flow and a closed position that prevents air flow. Each fastening member is a zipper, although other types of fastening members, such as snap members, can be used in other constructions.

Figure 7:
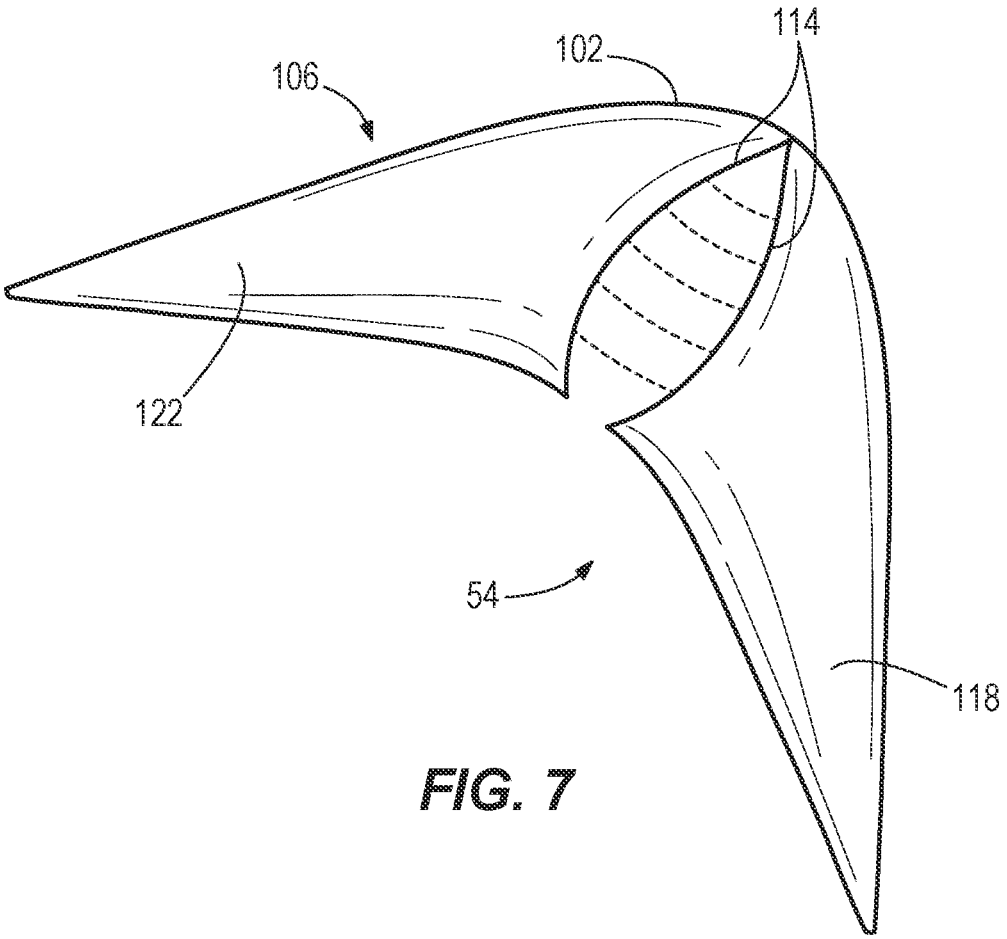
FIG. 7 is an enlarged perspective view of the wing of FIG. 2 illustrating an exemplary sewing pattern method for a central seam.
Figure 8:
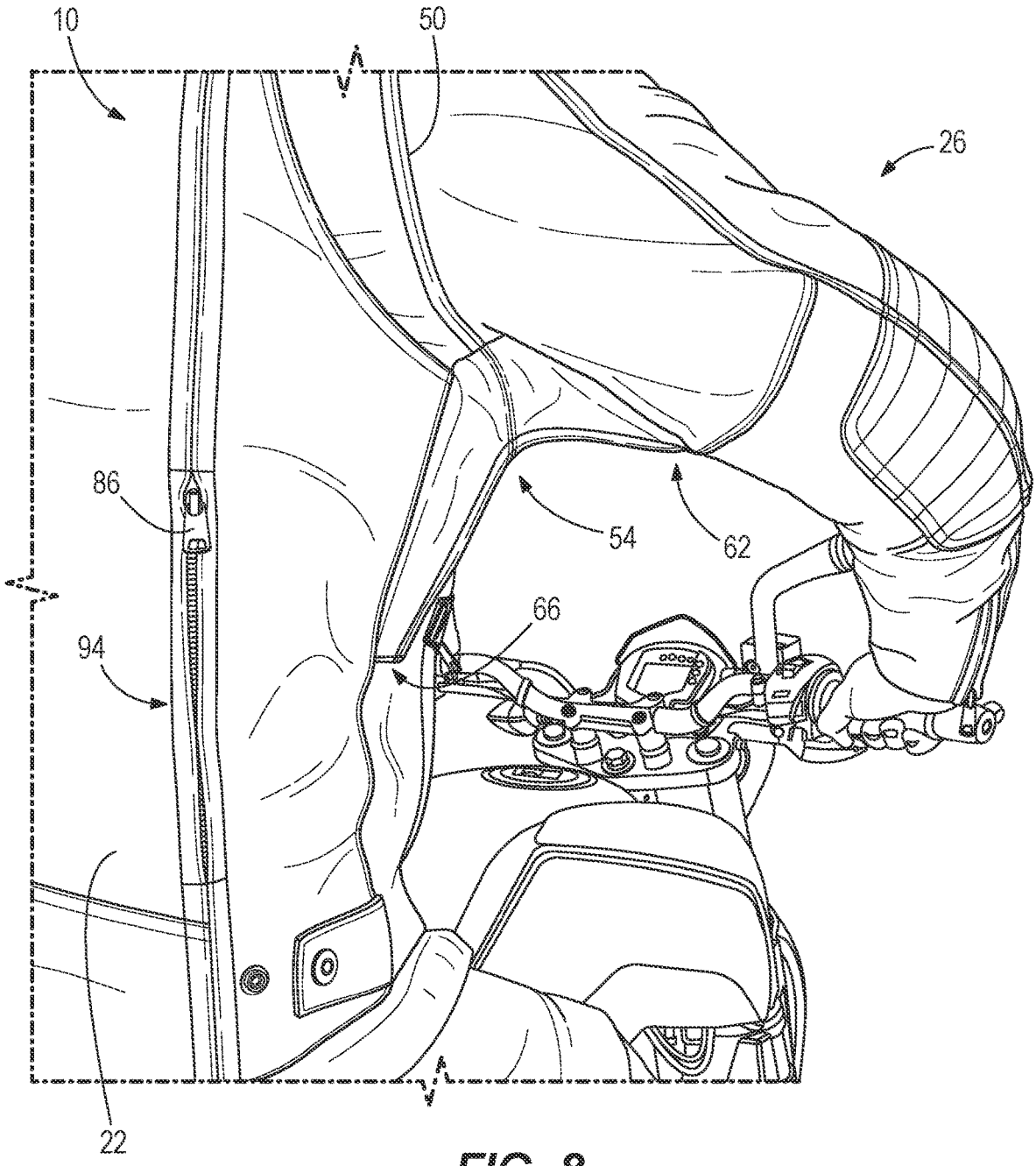
FIG. 8 is a perspective view of the ventilated jacket of FIG. 1, showing a rear side of the body portion.

Referring to FIGS. 2-5, 7 and 8, the jacket 10 further includes a wing 54 positioned at a rear side of the underarm vent 38 and extending along a path established by the underarm vent 38. When the jacket 10 is worn while riding a motorcycle, as shown in FIG. 8, each of the sleeves 27, 28 extends in an orientation away from the body portion 14 as the hands of a motorcyclist are gripping the handlebars of a motorcycle. In this position, the wing 54 is exposed to the traveling wind and is configured to channel and increase the flow rate of air into the underarm vent 38 for increased ventilation to the interior of the jacket 10.

When worn off the motorcycle, in a first configuration, the sleeves 27, 28 extend down along the body portion 14 of the jacket 10. The wing 54 then folds at a central portion, for example a central seam 114 formed on the wing 54, and becomes concealed between the body portion 14 and the respective sleeve 27, 28, as shown in FIG. 1. A second configuration is established as the left sleeve 27 and the right sleeve 28 becomes orientated at least 30 degrees from the body portion 14. This can be exemplified by the riding position of the motorcyclist. When no longer stowed or concealed between the body portion 14 and the sleeve 27, 28, the wing 54 is deployed and becomes exposed to air flow as the orientation of the pair of sleeve portions pulls the wing 54 taut, maintaining the position of the wing 54. In this configuration, the wing 54 can have a boomerang shape, as viewed from the front and/or the rear. The boomerang shape allows the wing 54 to effectively fit and perform under the curvature of the sleeve-to-body area of the jacket 10. The wing 54 with the boomerang shape is configured to capture air flow that passes in the vicinity of the jacket 10 underarm area and direct air flow into the underarm vent 38, e.g., during motorcycle riding. With the movement of the sleeves 27, 28 from the first configuration increasingly upward to the second configuration, the drag coefficient and venting effect imparted by the wing 54 are increased.

Figure 5:
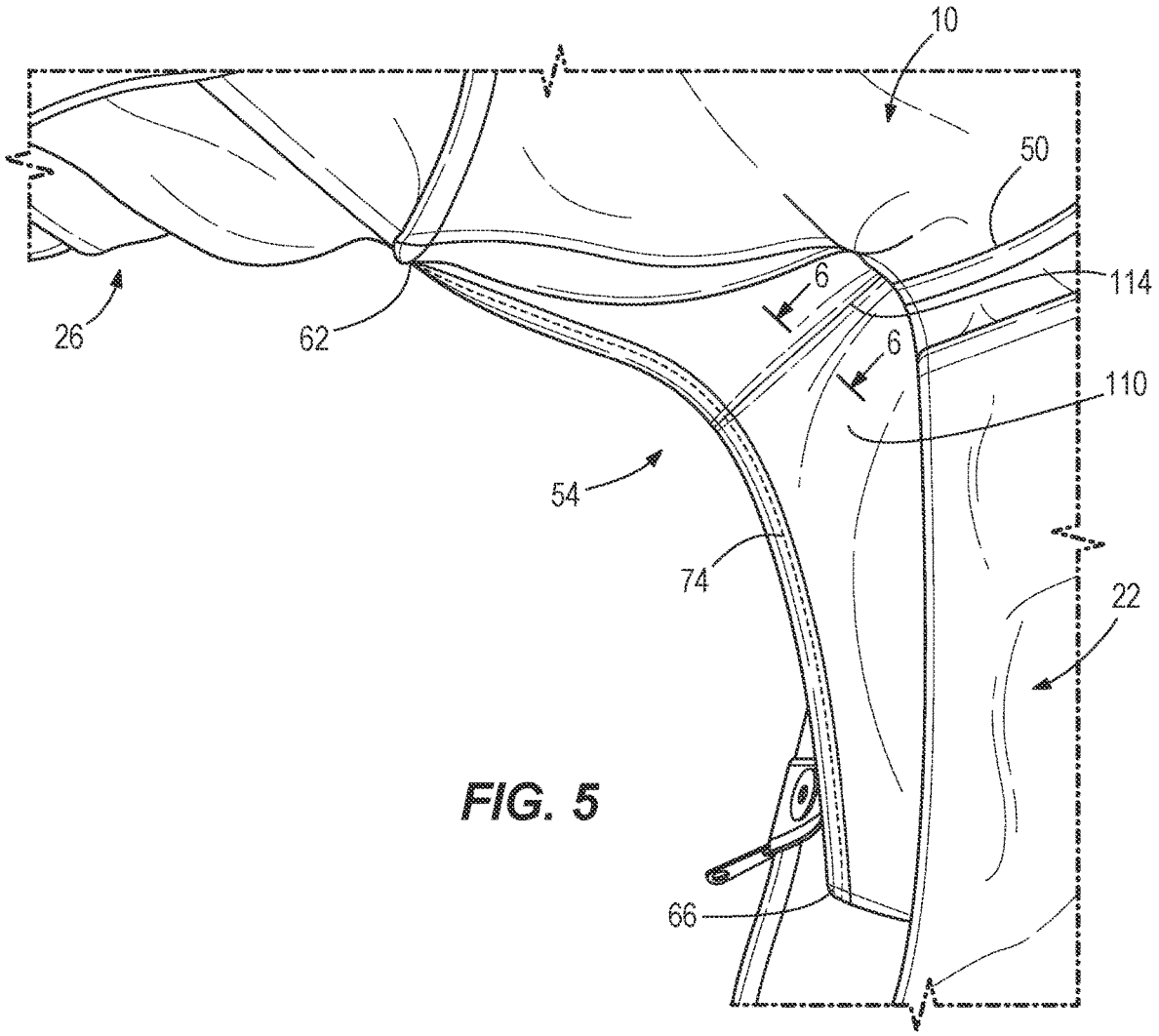
FIG. 5 is a rear view of the wing of FIG. 2.
Figure 6:
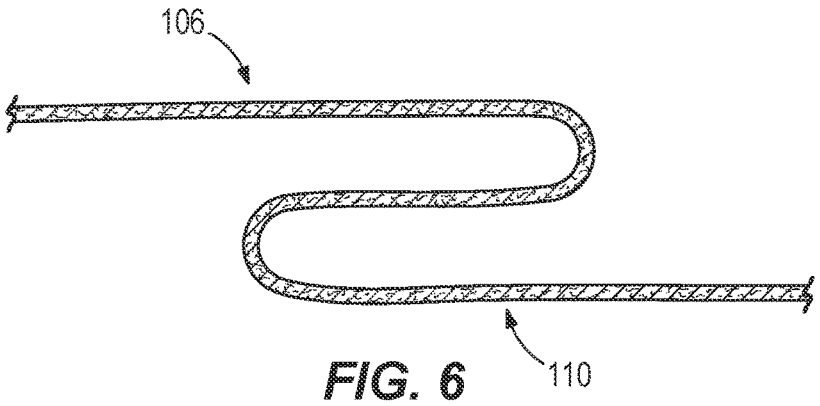
FIG. 6 is a cross-sectional view the wing of FIG. 2 taken along the section line 6-6 of FIG. 5, showing an exemplary sewing pattern to form a transverse dart.

Referring to FIGS. 3-5, the wing 54 includes a front portion 106, a rear portion 110, a first end 62, and a second end 66 opposite the first end 62. The first end 62 of the wing 54 is adjacent the first end 42 of the underarm vent 38 and extends (e.g., at least 25 to 50 mm) beyond the first end 42 of the underarm vent 38. The second end 66 of the wing 54 is adjacent the second end 46 of the underarm vent 38 and also extends (e.g., 25 to 50 mm) beyond the second end 46 of the underarm vent 38. The wing 54 extending past the underarm vent 38 increases the frontal area feeding the underarm vent 38. An inlet pressure at the underarm vent 38 is then increased by the additional frontal area, creating a higher flow rate of air. The wing 54 includes a distal edge 98 extending between the first end 62 and the second end 66 of the wing 54 and a proximal edge 102 spaced from the distal edge 98. The proximal edge 102 is secured to the body portion 14 and the respective sleeve 27, 28 along the path established by the rear side of the underarm vent 38. An attachment edge is defined by the proximal edge 102 and is configured to attach the wing 54 to the ventilated jacket 10.

Referring to FIG. 4, a height H of the wing 54 is characterized as the distance between the proximal edge 102 and the distal edge 98. The height H varies as a function of a coordinate direction S configured to travel along the path established by the rear side of the underarm vent 38. The height H is measured at each point along the coordinate direction S as the distance from the proximal edge 102 to a nearest point on the distal edge 98. When traversing along the coordinate direction S from the first end 62 to the second end 66, the height H varies in an increasing then decreasing manner. The height H has a measurement of zero at the first end 62 and at the second end 66, and has a maximum of about 50 mm to 90 mm. The area in which the maximum is measured is at or proximate the central seam 114.

The wing 54 is impervious to air, preventing air flow from penetrating the wing 54. In some constructions, the wing 54 is formed of an air impervious material such as natural or synthetic leather. In other constructions the front portion 106 of the wing 54 is formed of a first material, such as nylon, or other textile materials and the rear portion 110 of the wing 54 is formed of a second material, such as leather. By preventing air flow through the wing 54, more air flow can be directed into the underarm vent 38. The wing 54 is also formed of one or more non-stretch materials configured to have a range of 0%-5% stretch. The range at which the material of the wing 54 stretches helps maintain the exposure of the wing 54 as the pair of sleeve portions are extending from the body portion 14.

In some constructions, the wing 54 includes a cord 74 extending along the distal edge 98 of the wing 54. The cord 74 can be secured at one end relative to the body portion 14 and at the other end relative to the respective sleeve 27, 28. The cord 74 is configured to pull the distal edge 98 of the wing 54 taut as the sleeve is held in an extended orientation away from the body portion 14. The cord 74 allows the wing 54 to maintain the boomerang shape as wind comes in contact with the wing 54, for example when riding a motorcycle. The cord 74 can be formed of a polymer such as PTFE (e.g., Teflon®), a metallic cable, adhesive material formed together, or other materials. The material of the cord 74 permits folding, curving, or twisting to different shapes to allow mobility of the sleeves 27, 28 relative to the body portion 14, while having a high resistance to stretching so that it helps to maintain the shape of the wing 54 against wind when pulled taut.

To construct the wing 54, either a first sewing pattern method, or a second sewing pattern method can be used. The first method includes sewing together two pieces of fabric having opposing curvature, as shown in FIG. 7. The two pieces of fabric include a first portion 118 extending between the central seam 114 of the wing 54 and the body portion 14 and a second portion 122 extending between the central seam 114 of the wing 54 and the respective sleeve 27, 28. Specifically, the edges of the first portion 118 and the second portion 122 have opposing curvature and are brought together along the broken lines of FIG. 7 to form the central seam 114. During the sewing process, the first portion 118 and the second portion 122 are stretched and pulled tight, therefore making the wing 54 resistant to deformation when confronted with wind forces. The second method can be used to form a transverse dart that causes the fabric of the wing 54 to overlap itself as shown in the cross-section view of FIG. 6. To form the transverse dart, a triangular shape is outlined on a piece of fabric, in which the bottom portion of the shape is pinched and creates an apex at the top of the shape. Pins can then be inserted into the fabric to hold the dart in place. The transverse dart is then sewn together along the outline of the triangular shape, from the bottom portion to the apex. To achieve the boomerang shape of the wing 54 and fit the wing 54 under the curvature of the pair of sleeve portions, either sewing pattern method can be used.

The first sewing pattern method and the second sewing pattern method produce the central seam 114 that extends across the wing 54, between the distal edge 98 and the proximal edge 102. The central seam 114 is configured to inhibit the wing 54 from folding rearward or overlapping itself as wind contacts the wing 54. In other words, structural support is added to the wing 54 by formation of the central seam 114 as described above.

In addition to directing more air flow into the underarm vents 38, the wings 54 can also impart more operational balance to the ventilation system of the jacket 10. Unlike the underarm vents 38, the front vents 90 are directly exposed to oncoming wind. The wings 54 enhance the flow through the underarm vents 38 by simulating forward-facing vents as the wings 54 direct oncoming wind into the underarm vents 38. Without the wings 54, the underarm areas may receive substantially less airflow, even when the underarm vents 38 are fully open, since the underarm vents 38 generally face laterally outward.

Various features and advantages of the invention are set forth in the following claims.

What is claimed is:

1. A ventilated jacket comprising:

a body portion having a front side and a rear side, wherein the front side of the body portion contains a central fastening member that extends continuously from a top to a bottom of the front side;

a sleeve portion extending from the body portion and connecting to the body portion via an armscye seam; a ventilation system including a plurality of vents configured to allow airflow into and out of the ventilated jacket, the plurality of vents includes an underarm vent having a first end and a second end, the underarm vent extends across the armscye seam in an axillary region between the body portion and the sleeve portion; and a wing attached on the rear side of the body portion at a rear side of the underarm vent, wherein the wing follows a path established by the rear side of the underarm vent, the wing-includes a first end adjacent the first end of the underarm vent and a second end adjacent the second end of the underarm vent, the wing extending outward from the underarm vent to channel oncoming air into the underarm vent when the sleeve portion is held in an extended orientation away from the body portion.

2. The ventilated jacket of claim 1, wherein the wing is impervious to air and has a boomerang shape when the sleeve portion is held in the extended orientation away from the body portion.

3. The ventilated jacket of claim 1, wherein the wing includes a central seam formed by pieces of non-stretch material having opposing curvatures, in which the opposing curvatures are sewn together to make a boomerang shape of the wing and fit the wing along the rear side of the underarm vent.

4. The ventilated jacket of claim 1, wherein the wing further includes a cord positioned along a distal edge of the wing, the cord configured to extend taut between the first end of the wing and the second end of the wing when the sleeve is held in the extended orientation.

5. The ventilated jacket of claim 1, wherein a height of the wing measured from a proximal edge to a distal edge varies in an increasing then decreasing manner from the first end of the wing to the second end of the wing and has a maximum of 50 to 90 mm.

6. The ventilated jacket of claim 1, wherein the first end of the wing is positioned between 25-50 mm beyond the first end of the underarm vent, and the second end of the wing is positioned at least 25-50 mm beyond the second end of the underarm vent.

7. The ventilated jacket of claim 1, wherein the ventilation system further includes a front vent extending along the front side of the body portion and a rear vent extending along the rear side of the body portion.

8. The ventilated jacket of claim 1, wherein the wing includes a transverse dart configured to shape and fit the wing along the rear side of the underarm vent.

9. A ventilated jacket comprising:

a body portion having a front side and a rear side, wherein the front side of the body portion contains a central fastening member that extends continuously from a top to a bottom of the front side; a sleeve portion extending from the body portion and connecting to the body portion via an armscye seam;

an underarm vent that extends across the armscye seam in an axillary region between the body portion and the sleeve portion including a first fastening member configured to move the underarm vent between an open position and a closed position;

a front vent extending along the front side of the body portion including a second fastening member configured to move the front vent between an open position and a closed position;

a rear vent extending along the rear side of the body portion including a third fastening member configured to move the rear vent between an open position and a closed position; and a wing attached on the rear side of the body portion at a rear side of the first fastening member of the underarm vent, the wing includes a first end and a second end, wherein the wing has a boomerang shape that directs air into the underarm vent.

10. The ventilated jacket of claim 9, wherein the wing further includes a cord positioned along a distal edge of the wing, the cord configured to extend taut between the first end of the wing and the second end of the wing.

11. The ventilated jacket of claim 9, wherein a height of the wing measured from a proximal edge to a distal edge varies in an increasing then decreasing manner from the first end of the wing to the second end of the wing and has a maximum of 50 to 90 mm.

12. The ventilated jacket of claim 9, wherein the wing is impervious to air.

13. The ventilated jacket of claim 9, wherein the wing includes a central seam formed by pieces of non-stretch material having opposing curvatures, in which the opposing curvatures are sewn together to make the boomerang shape of the wing and fit the wing along the rear side of the first fastening member of the underarm vent.

14. The ventilated jacket of claim 9, wherein the wing includes a transverse dart configured to shape and fit the wing along the rear side of the first fastening member of the underarm vent.

15. A ventilated jacket comprising:

a body portion having a front side and a rear side, wherein the front side of the body portion contains a central fastening member that extends continuously from a top to a bottom of the front side;

a sleeve portion extending from the body portion and connecting to the body portion via an armscye seam;

a ventilation system including a plurality of vents configured to allow airflow into and out of the ventilated jacket, the plurality of vents includes an underarm vent having a first end and a second end, the underarm vent extends across the armscye seam in an axillary region between the body portion and the sleeve portion; and a wing attached on the rear side of the body portion at a rear side of the underarm vent, wherein the wing follows a vent path established by the rear side of the underarm vent;

the wing includes: a first end adjacent the first end of the underarm vent, a second end adjacent the second end of the underarm vent, a proximal edge secured to the body and sleeve portions along the vent path, and a distal edge spaced from the vent path, wherein the wing includes a central seam formed by sewing together pieces of non-stretch material having opposing curvatures.

16. The ventilated jacket of claim 15, wherein the wing has a boomerang shape when the sleeve portion is held in the extended orientation away from the body portion.

17. The ventilated jacket of claim 15, wherein the wing is impervious to air.

18. The ventilated jacket of claim 15, wherein the ventilation system further includes a front vent extending along the front side of the body portion and a rear vent extending along the rear side of the body portion.

19. The ventilated jacket of claim 15, wherein a height of the wing measured from the proximal edge to the distal edge varies in an increasing then decreasing manner from the first end of the wing to the second end of the wing and has a maximum of 50 to 90 mm.

20. The ventilated jacket of claim 15, wherein the wing further includes a cord positioned along the distal edge of the wing, the cord configured to extend taut between the first end of the wing and the second end of the wing.

21. The ventilated jacket of claim 15, wherein the opposing curvatures are defined by a first concave edge and a second concave edge that together join at the central seam, the first concave edge inwardly curving in a first direction away from the second concave edge, and the second concave edge inwardly curving in a second direction away from the first concave edge.

* * * * *